US007611622B2

(12) United States Patent
Niccum et al.

(10) Patent No.: US 7,611,622 B2
(45) Date of Patent: Nov. 3, 2009

(54) FCC PROCESS FOR CONVERTING C3/C4 FEEDS TO OLEFINS AND AROMATICS

(75) Inventors: Phillip K. Niccum, Houston, TX (US); Eusebius A. Gbordzoe, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 270 days.

(21) Appl. No.: 11/648,031

(22) Filed: Dec. 29, 2006

(65) Prior Publication Data

US 2008/0156696 A1 Jul. 3, 2008

(51) Int. Cl.
*C10G 51/06* (2006.01)

(52) U.S. Cl. ..... 208/78; 208/49; 208/67; 208/120.01

(58) Field of Classification Search ..... 208/49, 208/67, 78, 120.01
See application file for complete search history.

(56) References Cited

U.S. PATENT DOCUMENTS 3,758,403 A * 9/1973 Rosinski et al. ..... 502/67
4,180,689 A 12/1979 Davies et al.
4,636,483 A 1/1987 Kjell et al.
4,746,763 A 5/1988 Kocal
4,761,511 A 8/1988 Barlow
4,834,867 A 5/1989 Gilson
4,855,522 A 8/1989 Diaz
5,169,812 A 12/1992 Kocal et al.
5,258,564 A 11/1993 Kocal et al.
5,877,368 A 3/1999 Kiyama et al.
6,063,974 A 5/2000 Drake et al.
6,228,789 B1 5/2001 Wu et al.
6,287,522 B1 * 9/2001 Lomas ..... 422/144
6,617,275 B1 9/2003 Sharma et al.
6,657,096 B2 12/2003 Boehner et al.
7,011,740 B2 3/2006 Tallman et al.
7,128,827 B2 10/2006 Tallman et al.
2005/0150817 A1 * 7/2005 Tallman et al. ..... 208/78

OTHER PUBLICATIONS

Niccum, P.K. et al. (2004). "KBR Fluid Catalytic Cracking Process" in Handbook of Petroleum Refining Processes, 3rd ed. Edited by R.A. Meyers, McGraw-Hill, pp. 3.1-3.34.*

* cited by examiner

*Primary Examiner*—Robert J Hill, Jr.
*Assistant Examiner*—Brian McCaig

(57) ABSTRACT

A dual riser FCC process for converting $C_3/C_4$-containing feedstocks to aromatics. First and second hydrocarbon feeds (5, 6) are supplied to the respective first and second risers (2, 4) in a dual-riser FCC unit with a gallium enriched catalyst to make an effluent rich in ethylene, propylene and aromatics. The first riser (2) is operated at less severe conditions than the second riser (4) and can receive a relatively heavy feed such as gas oil. The feed to the second riser (4) includes propane, for example LPG, propane recycle from the C3 splitter (72), etc. The FCC catalyst can include gallium to promote aromatics formation.

18 Claims, 2 Drawing Sheets

FCC PROCESS FOR CONVERTING C3/C4 FEEDS TO OLEFINS AND AROMATICS

BACKGROUND

1. Field

Embodiments herein generally to the operation of dual-riser fluidized catalytic cracking (FCC) units to produce olefins and/or aromatics from light hydrocarbon feedstocks, and in particular from feedstocks rich in C3 and/or C4 hydrocarbons.

2. Description of the Related Art

Fluid catalytic cracking (FCC) technology has been employed for more than 50 years in refineries to maximize yields for transportation fuels such as gasoline and distillates. The FCC process uses a reactor called a riser which is essentially a pipe in which a hydrocarbon feed gas is intimately contacted with small catalyst particles to effect the conversion of the feed to more valuable products. The FCC unit typically converts gas oil feeds by "cracking" the hydrocarbons into smaller molecules. The resulting hydrocarbon gas and catalyst mixture both flow in the riser, hence the term fluid catalytic cracking.

As employed in today's refineries, the FCC unit has found use in converting primarily heavy feeds, such as vacuum gas oils, reduced crudes, atmospheric tower bottoms, vacuum tower bottoms and the like, into more transportation fuel products such as gasoline, diesel, heating oils, and liquefied petroleum gases. To increase yields from the FCC unit of more valuable petrochemicals, such as ethylene and propylene, refineries are operating at high severity and/or using light feedstocks such as light cracked naphtha in the riser to co-crack with heavy feeds.

The cracking reaction is endothermic, meaning that heat must be supplied to the reactor process to heat the feedstock and maintain reaction temperature. During the conversion process with heavy feeds, coke is formed. The coke is deposited on the catalyst and ultimately burned with an oxygen source such as air in a regenerator. Burning of the coke is an exothermic process that can supply the heat needed for the cracking reaction. The resulting heat of combustion from regeneration increases the temperature of the catalyst, and the hot catalyst is recirculated for contact with the feed in the riser, thereby maintaining the overall heat balance in the system. In balanced operation, no external heat source or fuel is needed to supplement the heat from coke combustion. Should a heat imbalance exist, such as making too much coke and generating excessive heat for the reactions, it is possible to use a catalyst cooler or other process modifications in mitigation, especially with heavy feeds or high severity operation. As practiced today, the FCC unit primarily cracks gas oil and heavier feeds.

The prior art teaches the conversion of light feeds such as C4+ olefinic and paraffinic streams to more valuable products such as propylene. This process technology is commercially available under the trade designation SUPERFLEX. The processing of light feeds, generally with carbon numbers less than 12, poses its own unique issues with regards to two critical areas, namely maximizing the propylene and ethylene yields, and maintaining the heat balance with insufficient coke make. These issues become even more important as lighter feeds are contacted with catalysts formulated specifically for light feeds and higher ethylene and propylene production.

Unlike heavy feeds, light feeds do not make enough coke to maintain heat balance in the FCC unit. Thus, an external source of heat input is required to keep the FCC unit in heat balance when using predominantly light feeds. U.S. Pat. No. 7,011,740 teaches the use of an import fuel oil to remove catalyst fines from the riser reactor effluent, and combusting the imported fuel oil to heat balance the FCC unit. Special regenerators, for the continuous firing of fuel in the regenerator for use in an FCC unit with a light feed, are known (as an example, see commonly assigned U.S. patent application Ser. No. 10/065,376, filed Oct. 10, 2002 (Publication US 20040069681)).

To maximize the utilization of low value feeds within a refinery or petrochemicals complex, producers have introduced much lighter feeds into the FCC unit. Lighter feeds require a hotter riser temperature to crack efficiently, but when introduced in a small proportion into a heavy feed stream, will lead to even more coke production. This occurs because although the coke make from lighter feeds is significantly lower than for heavy feeds at the same temperature, the coke make from the heavy feed is increased at the higher operating temperatures. Conditions that maximize the production of propylene generally require relatively high temperatures that increase coke production, particularly from the heavy feed. Light feeds rarely make 1 percent coke, while the coke yield from heavy feeds could be as high as 10-15 percent. The excess coke from heavy feed under propylene-maximizing conditions would generally lead to a system heat imbalance, unless a catalyst cooler were used.

In the prior art, use of the excess heat from the coke formed in the heavy feed riser to supply the heat of reaction required by the lighter feed supplied to a second riser is known to be generally more efficient (See Eng et al., "Economic Routes to Propylene," *Hydrocarbon Asia*, p. 36 (July/August 2004), which discloses the production of transportation fuels from a heavy feed such as vacuum gas oil in a conventional FCC unit as a baseline). However, if the goal is to maximize petrochemicals, the FCC unit can use both heavy and light feeds. A variation on the SUPERFLEX process is the use of a dual riser reactor known under the trade designation SUPERFLEX PLUS. In the dual riser process, a light feedstock is supplied to one riser to produce the olefins that are desired, while a conventional resid or heavy feedstock is supplied to another riser to make gasoline and/or distillates. The catalyst from the dual risers is regenerated in a common regenerator. The heat from regenerating the coke deposits, primarily on the catalyst from the heavy feed riser, is balanced for operation of both risers. Because optimum cracking conditions for the heavy feed and light feed are usually much different, this paper teaches that the complete segregation of a heavy feed from a light feed cracked in dual risers will lead to benefits in yields and operation.

Integration of gas oil and light olefin catalytic cracking zones with a pyrolytic cracking zone to maximize efficient production of petrochemicals is known (See commonly assigned U.S. Pat. No. 7,128,827). Integration of the units in parallel allows production of an overall product stream with maximum ethylene and/or propylene by routing various feedstreams and recycle streams to the appropriate cracking zone (s), e.g. ethane/propane to the steam pyrolysis zone, waxy gas oil to a high severity cracking zone and $C_4$-$C_6$ olefins to the light olefin cracking zone, enhancing the value of the material balances produced by the integrated units.

Processes for catalytically and non-catalytically cracking hydrocarbon feedstocks are well known. Steam cracking in a furnace and contact with hot non-catalytic particulate solids are two well-known non-catalytic cracking processes. Exemplary processes are described in U.S. Pat. Nos. 3,407,789; 3,820,955; 4,499,055; and 4,814,067. Fluid catalytic cracking and deep catalytic cracking are two well-known catalytic cracking processes. U.S. Pat. Nos. 4,828,679; 3,647,682; 3,758,403; 4,814,067; 4,980,053; and 5,326,465 disclose exemplary processes.

Zeolite-based heterogeneous catalysts are used by industrial chemical companies in the interconversion of hydrocarbons in an FCC unit for example, and in the alkylation of aromatic compounds. A very good example is the zeolite ZSM-5. This zeolite, developed by Mobil Oil, is an aluminosilicate zeolite with a high silica and low alumininum content. Its structure is based on channels with intersecting tunnels. The aluminium sites are very acidic. The substitution of Al3+ in place of the tetrahedral Si4+ silica requires the presence of an added positive charge. When this is H+, the acidity of the zeolite is very high. The reaction and catalysis chemistry of the ZSM-5 is due to this acidity.

While much of the prior art directed to light hydrocarbon processing in FCC reactors focuses on improved olefin yields, there remains a need for improving the yield of aromatics, especially from low value light hydrocarbon feedstocks such as liquefied petroleum gas (LPG).

BRIEF DESCRIPTION OF THE DRAWINGS

So that the manner in which the above recited features of the present embodiments can be understood in detail, a more particular description of the embodiments, briefly summarized above, may be had by reference to embodiments, some of which are illustrated in the appended drawings. It is to be noted, however, that the appended drawings illustrate only typical embodiments and are therefore not to be considered limiting of its scope, for the embodiments may admit to other equally effective embodiments.

DESCRIPTION OF EMBODIMENTS

Figure 1:
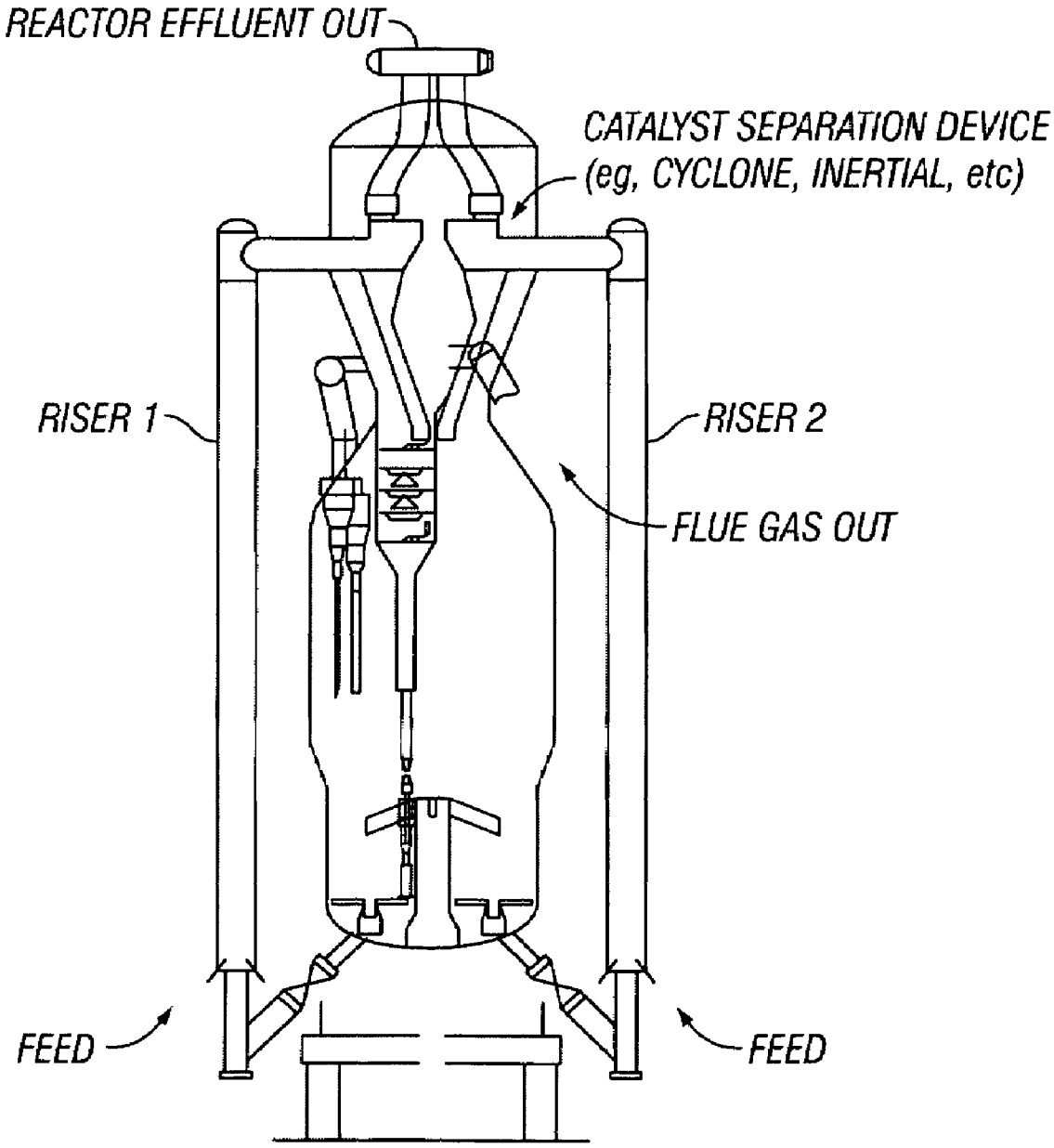
FIG. 1 is a schematic representation of a dual riser FCC reactor.

A detailed description will now be provided. Each of the appended claims defines a separate embodiment, which for infringement purposes is recognized as including equivalents to the various elements or limitations specified in the claims. Depending on the context, all references below to the "embodiment" may in some cases refer to certain specific embodiments only. In other cases it will be recognized that references to the "embodiment" will refer to subject matter recited in one or more, but not necessarily all, of the claims. Each of the embodiments will now be described in greater detail below, including specific embodiments, versions and examples, but the embodiments are not limited to these embodiments, versions or examples, which are included to enable a person having ordinary skill in the art to make and use the embodiments, when the information in this patent is combined with available information and technology.

A dual riser FCC system can be used to process a light hydrocarbon feed stream containing $C_3$'s, $C_4$'s or a combination thereof, hereinafter referred to as "$C_3/C_4$", to one of the risers with a gallium-containing catalyst to favor olefin and/or aromatics production. Thus, inexpensive $C_3/C_4$ feedstocks such as LPG can be converted to aromatics using an FCC unit.

In an embodiment, a fluid catalytic cracking (FCC) process can convert a $C_3/C_4$-rich feed to olefins and aromatics. The process includes cracking a first hydrocarbon feed in a first riser under first-riser FCC conditions to form a first effluent enriched in cracked hydrocarbons. The first-riser FCC conditions can include a residence time from 0.1 to 10 seconds. Another step can include cracking a second hydrocarbon feed comprising light hydrocarbons including $C_3/C_4$ in a second riser under second-riser FCC conditions to form a second effluent enriched in light olefins and aromatics. The second-riser FCC conditions can have a higher severity than the first-riser FCC conditions, and can include a residence time from 0.1 to 10 seconds and a temperature from 510° C. to 710° C. (950° F. to 1300° F.). The first- and second-riser FCC conditions can include a gallium-promoted alumina catalyst.

The process can include recovering the catalyst and separating hydrocarbons including light olefins and aromatics from the first and second FCC effluents, regenerating the recovered catalyst by combustion of coke in a common regenerator to obtain hot, regenerated catalyst, and recirculating the hot regenerated catalyst to the first and second risers.

The first hydrocarbon feed can be a relatively heavy feedstock, such as, for example, gas oil, including vacuum gas oil and atmospheric tower bottoms, or the like.

The second hydrocarbon feed can be any light hydrocarbon stream containing propane, such as, for example, liquefied petroleum gas (LPG). In another embodiment, the second hydrocarbon feed can also include a recycle stream recovered from the separated hydrocarbons, such as, for example, paraffinic and cycloparaffinic hydrocarbons having from 3 to 12 carbon atoms, especially propane from a C3 splitter.

In an embodiment, the second-riser FCC conditions can include, relative to the first-riser FCC conditions, a higher temperature, higher catalyst-to-oil ratio, lower hydrocarbon partial pressure, lower steam-to-oil ratio, longer residence time, or any combination thereof.

In another embodiment, the process can include conditioning gas separated from the first and second effluents to remove oxygenates, acid gases, water or a combination thereof to form a conditioned stream, and separating the conditioned stream into at least a tail gas stream, an ethylene product stream, a propylene product stream, a light stream comprising ethane, propane, or a combination thereof, an intermediate stream comprising olefin selected from $C_4$ to $C_6$ olefins and mixtures thereof, and a heavy stream comprising $C_6$ and higher hydrocarbons. The light stream can be recycled to the second riser. The intermediate stream can be recycled to the second riser and the heavy stream to the first riser. In an embodiment, the first and second effluents can be mixed and conditioned together in a common conditioning unit.

In another embodiment, the process can also include hydrotreating the heavy stream and extracting a product stream comprising benzene, toluene, xylenes or a mixture thereof from the hydrotreated stream to obtain a raffinate stream lean in aromatics. The raffinate stream can be recycled to the second riser.

More broadly, the first hydrocarbon feed can include any hydrocarbon feedstock with hydrocarbons of 4 or more carbon atoms, such as, for example, gas oil, distillates, naphtha or the like, and specifically can include light hydrocarbons having from 4 to 20, preferably from 4 to 12 carbon atoms, such as paraffinic, cycloparaffinic, monoolefinic, diolefinic, cycloolefinic, naphthenic, and aromatic hydrocarbons, and hydrocarbon oxygenates. Representative examples include: light paraffinic naphtha: heavy paraffinic naphtha; light olefinic naphtha; heavy olefinic naphtha; mixed paraffinic C4's; mixed olefinic C4's such as raffinates; mixed paraffinic C5's; mixed olefinic C5's such as raffinates; mixed paraffinic and cycloparaffinic C6's; non-aromatic fractions from an aromatics extraction unit; oxygenate-containing products from a Fischer Tropsch unit; or the like; or any combination thereof. Hydrocarbon oxygenates generally include alcohols having carbon numbers of 1 to 4, ethers having carbon numbers of 2 to 8 and the like, e.g. methanol, ethanol, dimethyl ether, methyl tertiary butyl ether (MTBE), ethyl tertiary butyl ether, tertiary amyl methyl ether (TAME), tertiary amyl ethyl ether and the like.

As used herein, the terms "$C_3/C_4$ feedstock" or "$C_3/C_4$-rich" in reference to a feed or stream refer to a hydrocarbon feed or stream comprising at least 90 mole percent of compounds having three or four carbon atoms; "LPG" refers to a feedstock comprising a mixture primarily of C3 and C4 hydrocarbons which can also include small amounts of lighter and heavier hydrocarbons.

As used herein, the term "light" in reference to feedstock or hydrocarbons can refer to hydrocarbons having a carbon number less than about 12, and "heavy" can refer to hydrocarbons having a carbon number greater than about 12. As used herein, "carbon number" refers to the number of carbon atoms in a specific compound, or in reference to a mixture of hydrocarbons the weight average number of carbon atoms.

As used herein, "naphtha" or "full range naphtha" refers to a hydrocarbon mixture having a 10 percent point below about 175° C. (347° F.) and a 95 percent point below about 240° C. (464° F.) as determined by distillation in accordance with the method of ASTM D86; "light naphtha" to a naphtha fraction with a boiling range within the range of $C_4$ to about 166° C. (330° F.); and "heavy naphtha" to a naphtha fraction with a boiling range within the range of from about 166° C. (330° F.) to about 211° C. (412° F.).

As used herein, the term "paraffinic" in reference to a feed or stream refers to a light hydrocarbon mixture comprising about 80 weight percent or more paraffins, no more than about 10 weight percent aromatics, and no more than about 40 weight percent cycloparaffins.

As used herein, the term "aromatic" in reference to a feed or stream refers to a light hydrocarbon mixture comprising more than about 50 weight percent aromatics.

As used herein, the term "olefinic" in reference to a feed or stream refers to a light hydrocarbon mixture comprising about 20 weight percent or more olefins.

As used herein, the term "mixed $C_4$'s" in reference to a feed or stream refers to a light hydrocarbon mixture comprising about 90 weight percent or more of hydrocarbon compounds having 4 carbon atoms.

As used herein the term "waxy gas oil" refers to a gas oil comprising about 40 weight percent or more paraffins and having a fraction of about 50 percent or more by weight boiling above about 345° C. (653° F.).

As used herein, the term "dual riser" refers to FCC units employing two or more risers. While operating complexity and mechanical design considerations can limit the dual riser FCC unit to two risers as a practical matter, there is no theoretical reason precluding a dual riser FCC unit having three, four or even more risers. A dual riser FCC unit that can be used to process multiple feeds is depicted in FIG. 1.

As used herein, reference to a riser temperature can mean the temperature of the effluent exiting at the top of the riser. Because the riser reactions are usually endothermic, the thermal equilibrium of the riser feeds (preheated hydrocarbon, steam and catalyst) can be higher than the riser exit temperature and the temperature can vary throughout the riser depending on the reactions.

As used herein, a catalyst-to-oil ratio can mean the weight of catalyst feed to the riser to the weight of oil feed to the riser. Delta coke and/or coke make refer to the net coke deposited on the catalyst, expressed as a percent by weight of the catalyst. The proportion of steam in a feed refers to the proportion or percentage of steam based on the total weight of hydrocarbon feed to the riser (excluding catalyst).

In catalytic cracking, catalyst particles are heated and introduced into a fluidized cracking zone with a hydrocarbon feed. The cracking zone temperature can be maintained at from about 425° C. to about 705° C. (about 797° F. to about 1300° F.). Catalysts useful in fluidized catalytic cracking can include Y-type zeolites, USY, REY, RE-USY, faujasite and other synthetic and naturally occurring zeolites and mixtures thereof. Crystalline aluminosilicates used in the cracking of light feeds are exemplified by ZSM-5, also known as "MFI" or "Pentasil" zeolite, and similar catalysts. Exemplary FCC processes are disclosed in U.S. Pat. Nos. 4,814,067; 4,404,095; 3,785,782; 4,419,221; 4,828,679; 3,647,682; 3,758,403; and Re. 33,728.

Embodiments herein can include the use of a gallium-promoted catalyst such as gallium-promoted zeolite, for example. The gallium can be mechanically mixed with hot recirculating catalyst, for example by directly adding the gallium to a catalyst regenerator. The gallium can be deposited in-situ on the catalyst by spraying a suitable solution of gallium compound into the catalyst where the gallium can decompose into oxidation states. Alternatively or additionally, a gallium-promoted catalyst can be prepared before loading the catalyst into the regenerator.

Preparation of a gallium-promoted zeolite catalyst can be obtained via silylation, a known derivatization technique which involves replacement of an acidic hydrogen on a compound with an alkylsilyl group.

One method to pretreat a zeolite/promoter component composition for silylation can include, for example, mixing a zeolite, a gallium promoter and a binder capable of forming a spinel with the gallium promoter; and subjecting the resulting mixture to a high temperature water vapor treatment to give a zeolite/spinel promoter composition ready for silylation. A commercial spinel can be utilized as the promoter component.

Zeolite starting material can include any zeolite which is effective in the conversion of non-aromatics to aromatics when contacted under suitable reaction conditions with non-aromatic hydrocarbons. The zeolite has a constraint index as defined in U.S. Pat. No. 4,097,367 in the range of about 0.4 to about 12. The molar ratio of $SiO_2$ to $Al_2O_3$ in the crystalline framework of the zeolite can be about 5:1 and can range up to infinity. The zeolites can include ZSM-5, ZSM-8, ZSM-11, ZSM-12, ZSM-35, ZSM-38, for example, and mixtures thereof. The zeolites can be described as crystalline aluminosilicates. Suitable aluminosilicates can have a medium pore size, which can be an effective fine porous size of 5-6.5 angstroms, although small (from about 3 to about 5 Å) or large pore (from about 7 to about 8 Å) zeolites can also be used. Silicoaluminophosphate zeolites such as SAPO-11 can also be used.

The gallium promoter component can be in the form of elemental gallium, a salt, oxide or hydroxide or it can be an organic compound. Examples of suitable modifiers can include gallium oxide, gallium chloride and gallium nitrate. Mixtures of two or more gallium compounds or a mixture of one or more zinc compounds and one or more gallium compounds can be used.

A suitable amount of gallium promoter can be from about 1 to about 10 weight percent as metal based on the total weight of the zeolite/promoter component composition. By total weight of the zeolite/promoter component composition is meant a calcined product containing the zeolite and the promoter component after a high temperature water vapor treatment. Amounts less than about 1 weight percent can be used, i.e. as little as about 0.1 weight percent but the benefit in the hydrocarbon conversion utility can be reduced. More than about 10 weight percent, i.e. up to about 25 weight percent can be used, but little, if any, additional benefit in the hydrocarbon conversion utility can result. The total weight can be based on the weight of the composition just prior to silylation less the weight of any unreacted binder, it being contemplated that generally an excess of binder is used so that after the high temperature water vapor treatment the binder which is generally required in the final product is already present. Alternatively, just enough binder can be used for the reaction with the gallium promoter to give the spinel.

The method of obtaining the modified zeolite composition for silylation described above can be carried out by combining the zeolite, the gallium promoter component, and binder by a known method such as ion exchange, impregnation, or kneading and thereafter subject the resulting mixture to the water vapor treatment. A sol of the binder can be mixed with dry powder zeolite and the gallium promoter component. Alternatively, an aqueous solution of the promoter can be used. The zeolite, gallium promoter component and binder can be all three mixed together initially or any two can be mixed together and thereafter the third mixed therewith. The mixing can be carried out until essentially complete mixing results. This mixture can then be given the water vapor treatment.

The water vapor treatment can be carried out at a high temperature. The temperature can be above 125° C. (257° F.) and can be within the range from about 300 to about 900° C. (about 600 to about 1700° F.). The time can be sufficient to effect the metal stabilization and can be from about 0.1 to about 50 hours. Within these ranges, shorter times can be used toward about the upper end of the temperature range and longer times can be used at about the lower end of the temperature range. A partial pressure of water vapor of from about 0.1 to about 10 kg/cm$^2$ (from about 1 to about 150 psia) can be used. This treatment can be done in water vapor alone. Alternatively, the treatment can be done with water vapor in the presence of a diluent such as nitrogen or air. This water vapor treatment can be viewed as a steam treatment carried out under a pressure in the range of from about subatmospheric to about 21,000 kPa (about 3000 psia). The steam can be superheated instead saturated.

The zeolite can be acid leached or non acid leached. Acid leaching can remove framework alumina, and can further remove alumina from the pores of the zeolite. Blocked pores can inhibit access of the reactants to reactive sites in the pores, and hence acid leaching to remove "extra-framework" alumina can be advantageous.

Several suitable techniques are known for treating the zeolite starting material with acid. The zeolite can be soaked with an acid solution by suitable known techniques for contacting the zeolite with such acid solution. The acid solution used to treat the zeolite can be a solution of any acid that suitably provides for leaching of aluminum atoms from the zeolite crystalline structure. Examples of such suitable acids include, but are not limited to, sulfuric, phosphoric, nitric and hydrochloric. The zeolite can be soaked in the acid solution for a period of from about 0.25 hours to about 10 hours. After soaking, a resultant acid treated zeolite can be washed free of the acid and then can be dried or calcined, or both.

The metal modified zeolite can, if desired, be silylated to reduce coke forming tendencies of the catalyst. Alternatively, the zeolite can be free of silylation to promote coke formation where coke formation might otherwise be insufficient for steady state regeneration of the catalyst, depending on the feed. In one embodiment, partial silylation can be used to control the amount of coke formation to achieve heat balanced catalyst regeneration. Zeolite silylation can be carried out by precalcining the metal modified zeolite prior to silylation or, alternatively or additionally, by silylating a plurality of times. After each silylation, the silylated composition can be dried and calcined so with multiple silylations, the composition can be precalcined for all of the silylations subsequent to the first as a result of post calcination of the prior silylation.

A silylating agent can be any suitable silicon containing compound that effectively treats the metal modified zeolite so as to provide a silylated, metal modified zeolite that can be effective in giving a low rate of coke formation when used in converting hydrocarbons such as gasoline to aromatics and olefins. The silylating agent can be, for example, an organosilicon compound selected from compounds having the formulas SiRyX4−y and $(R_wX_{3-w}Si)_2Z$ wherein y is from about 1 to about 4; w is from about 1 to about 3; R is selected from hydrogen and alkyl, aryl, alkoxy, arylalkyl, and the like where R has from about 1 to about 10 carbon atoms; X is halide; and Z is oxygen, imino, alkylimino, alkanoylimino and the like.

The silylating agent can be selected from a group of tetra alkyl orthosilicates, $Si(OR)_4$, and poly(alkyl)siloxanes. Examples can include tetraethyl orthosilicate, also known as tetraethoxysilane, and poly(phenylmethyl)siloxane. All of these silylating agents can be commercially available, the siloxanes being available, for example, from Dow Chemical Co. under trade designations such as DOW 200, DOW 510, DOW 550 and DOW 710. Other representative examples can include dimethyl silicone, diethyl silicone, phenylmethyl silicone, methylhydrogen silicone, ethylhydrogen silicone, phenylhydrogen silicone, methylethyl silicone, phenylethyl silicone, diphenyl silicone, methyltrifluoropropyl silicone, ethyltrifluoropropyl silicone, polydimethyl silicone, tetrachlorophenylethyl silicone, tetrachlorophenylmethyl silicone, tetrachlorophenylhydrogen silicone, tetrachlorophenylphenyl silicone, methylvinyl silicone and ethylvinyl silicone. Examples of cyclic silicones include hexamethyl cyclotrisiloxane, octamethyl cyclotetrasiloxane, hexaphenyl cyclotrisiloxane and octaphenyl cyclotetrasiloxane and mixtures thereof.

Silylating the zeolite/modifier component can be accomplished by impregnating it with a solution of the silylating agent by incipient wetness techniques known in the art. The solution can be an aqueous solution or a hydrocarbon solution of the silylating agent. The silylating agent can be insoluble in water but soluble in hydrocarbon. Any suitable hydrocarbon solvent can be used including, for example, aromatics and other hydrocarbons having from about 4 to about 10 carbon atoms per molecule, including alkanes, cycloalkanes and olefins. The concentration of silylating agent in the solution can range upwardly to about the solubility limit of the silylating agent in the solvent. The concentration of the silylating agent in the solution can be in the range of from about 1 weight percent to about 99 weight percent.

The amount of silylating agent incorporated into the metal modified zeolite can be such as to provide a silylated, zeolite catalyst that effectively provides a low rate of coke formation during its use in the conversion of hydrocarbons, such as gasoline to aromatics and olefins. The silylating agent can be present in the metal modified zeolite composition after calcining in an amount upwardly to about 50 weight percent, calculated as $SiO_2$, of the resulting silylated zeolite catalyst. The amount of silylating agent incorporated into the zeolite catalyst can be in the range of from about 0.5 weight percent to about 40 weight percent, based on the total weight of the final zeolite catalyst. If a single impregnation is used the amount can be toward the lower end of these ranges and if enough multiple impregnations are used it can be toward the upper end. The silylation can be carried out from about 1 to about 20 times or more.

After the incorporation (or each incorporation in the case of multiple incorporations) of silylating agent into the zeolite, the thus impregnated zeolite can be dried at suitable drying conditions in the presence of air, and then calcined. The drying temperature can range from about 20° C. to about 125° C. (about 60° F. to about 257° F.) and can be performed over a time period of from 0.1 hours to about 4 hours. The calcination temperature can be in the range of from about 300° C. to about 700° C. (about 500° F. to about 1300° F.). The calcination can be performed in an air atmosphere for a time period of from about 0.1 hours to about 10 hours. While this process can be referred to as "calcination" which implies heating in an oxygen-containing atmosphere, and while air can be used for convenience, this can be a drying process in the precalcination and hence an inert atmosphere can be used. The silylating agent can react with acid sites on the surface and/or in the pores of the zeolite to alter the surface chemistry and water can interfere with this reaction. Hence "calcination" carried out prior to a silylation step can be designed to render the composition essentially anhydrous prior to the subsequent silylation. Hence a precalcination can be carried out prior to the first silylation process. The post calcination (after the final silylation and drying) can be carried out under times and temperatures within the ranges set out for the precalcination, and for convenience the atmosphere can be the same, i.e. air although it can be essentially inert. There can be an oxidation component here, since the silylation agent can be converted to an oxidized form. A calcination step can be carried out prior to the water vapor treatment.

In an alternative embodiment, the silylated zeolite can be given a high temperature water vapor treatment in addition to, or instead of, the water vapor treatment described hereinabove. The conditions for such water vapor treatment can be the same as for the water vapor treatments described hereinabove.

The inorganic binder (also called matrix material in the art) is any binder containing ingredients which can form a spinel with the modifier metal can be used in forming the promoter component. For example, binders can be selected from the group consisting of alumina, silica, silica-alumina, clays (such as bentonite), aluminum phosphate, and the like and mixtures thereof. The inorganic binder can facilitate forming the product into a form for a particular utility. For instance, if extruding and pelletizing the product for use as a catalyst, the binder can facilitate the extrusion and adds physical stability to the resulting catalyst pellets.

The binder material, which can function as a part of the catalyst preparation, can be, for example, alumina. Either hydrated alumina or anhydrous alumina can be used. Further, an alumina precursor that can produce either anhydrous alumina or hydrated alumina from hydrolysis, thermal decomposition, or oxidation can be used.

The amount of binder can be suitably from about 2 to about 50 weight percent, based on total catalyst weight after the silylation and final calcining. The ratio of ingredients can be further defined such that the molar ratio of binder to promoter metal can be 1 or more.

There can be three forms of silicon materials which are all different: (1) Zeolites can contain silicon atoms bound to four oxygen atoms in their framework structure; (2) The silylating agent, after calcination can be partially converted to $SiO_2$; and (3) Silica can be a binder. The silicon-oxygen structure in the zeolite can be a permanent part of the zeolite which is a part of what gives the zeolite its precise porous structure and thus makes zeolites so useful. The binder, whether alumina, silica, bentonite or something else can act as a "glue" to hold the zeolite particles together. The binder can surround the zeolite particles as a cohesive matrix without adhering to the surface and without entering into the pores. Hence the binder affect on the catalytic properties of the zeolite can be insignificantly, although in some instances the binder can provide an additional catalytic function. The silicon atoms of the silylating agent can be in the form of a compound, for example in solution, and can contact the surface and enter the pores on a molecular level and can attach to acid sites on the surface of the zeolite. Subsequent calcination can occur without the silicon atoms affecting the basic catalytic functions of the zeolite. This can be because, while in the form of $SiO_2$ while attached to remnants of the acid sites, the silicon atoms can be in the form of individual $SiO_2$ units chemically bound to the zeolite surface.

The silylated Ga-zeolite of this invention can contain other additives of the type known in the art for zeolite catalysts. For example, a hydrogenation/dehydrogenation component such as platinum can be included in the composition.

The catalytic cracking process described herein can include a reaction process wherein a catalyst can be contacted directly with a feedstock and a catalytically cracked product can be formed, a separation process wherein the catalyst can be separated from the catalytically cracked product, a stripping process wherein an amount of the hydrocarbon that remains with the separated coked catalyst can be removed, and a regeneration process wherein coke can be combusted for catalyst reuse in the reaction process. Several suitable alternatives known in the art exist for the previously mentioned reaction, separation, stripping, and regeneration processes.

A detailed process description of a fluid catalytic cracking process in accordance with embodiments of the present invention can begin with a feedstock preheating process. The feedstock can be preheated from waste heat provided from downstream process fractionation processes including, but not limited to, main fractionator pumparound systems. These main fractionator waste heat pumparound systems can circulate fractionator streams comprising any or all of cracked gasoline and heavier oils to facilitate the removal of heat from critical sections of the fractionator. The feedstock preheat temperature prior to reaction can ranges from about 90° C. to about 370° C. (about 200° F. to about 700° F.), but can be preheated up to about 510° C. (about 950° F.) and supplied to the riser as vapor or a two-phase mixed vapor and liquid stream.

The preheated feedstock can be contacted with a regenerated fluidized catalytic cracking catalyst provided at a temperature generally ranging from about 425° C. to about 815° C. (about 800° F. to about 1500° F.), and immediately reacted through and within a riser reactor or fluidized bed reactor. For heavy feeds cracked to produce transportation fuels, the mixture of catalytic cracking catalyst and catalytically cracked hydrocarbon can exit the riser reactor at a reaction temperature ranging from about 450° C. to about 680° C. (about 840° F. to about 1300° F.). The pressure of fluid catalytic cracking processes can range from about 68 kPa to about 690 kPa (about 10 psia to about 100 psia). Catalyst to oil ratios for heavy feeds, measured in weight of catalyst to weight of oil, generally can range from about 2:1 to about 20:1.

The risers in the dual riser process described herein can include a fluidized catalytic cracking zone for $C_3/C_4$ feedstocks. Such catalytic cracking units can be of the type designed to enhance aromatic yields from FCC feedstocks.

One such catalytic cracking unit can increase aromatic yields by combining the effects of catalyst formulations containing gallium-promoted ZSM-5 and dual riser hardware technology with a $C_3$ recycle stream to the $C_3/C_4$ riser.

Another form of FCC technology useful in one or both of the dual risers described herein can be a process that employs a fluidized catalytic reactor to convert hydrocarbons, for example gas oil, to a higher value product stream rich in aromatics. This FCC technology is available by license from Kellogg Brown & Root under the trade designation SUPERFLEX.

FCC naphtha can be re-cracked in the presence of a zeolitic catalysts such as gallium-promoted ZSM-5, with relatively high catalyst-to-oil ratios and high riser outlet temperatures, to produce aromatics. The riser can operate at a riser outlet temperature of from about 550° C. to about 720° C. (about 1000° F. to about 1400° F.). The operating pressure can range from about 40 kPa to about 700 kPa (about 5 psia to about 100 psia). Catalyst-to-oil ratios, measured in weight of catalyst to weight of oil, can range from about 5:1 to about 80:1.

A combination of high temperature and high levels of ZSM-5 can allow feed stream hydrocarbons to crack. A high riser outlet temperature and high heat of reaction can increase the effectiveness of the catalyst.

The reactor can include four sections: riser/reactor, disengager, stripper and regenerator. Associated systems for the reactor can be known FCC systems and can include air supply, flue gas handling and heat recovery. Reactor overheads can be cooled and washed to recover entrained catalyst, which can recycled back to the reactor. The net overhead product can be routed to a primary fractionator in an olefins plant, although, depending on the available capacity in a given plant, the reactor effluent could alternately be further cooled and routed to an olefins plant cracked gas compressor, or processed for product recovery in some other manner.

In one embodiment, one or both of the FCC risers in the dual riser unit can process a light feed with a coke precursor, wherein the light feedstock produces insufficient coke for heat balanced operation, and the coke precursor can be present to supply sufficient coke to facilitate heat-balancing both risers, or at least to reduce the amount of supplemental fuel required for heat balancing. If a heavy feedstock is used as a supplemental coke precursor, some heavy oil can be produced to aid in fines recovery.

The coke precursor can be a heavy feedstock such as a refinery stream boiling in a temperature range of from about 650° C. to about 705° C. (about 1200° F. to about 1300° F.). Alternatively, the heavy feedstock can be a refinery stream boiling in a range from about 220° C. to about 645° C. (about 420° F. to about 1200° F.). A hydrocarbon fraction boiling at a temperature ranging from about 285° C. to about 645° C. (about 545° F. to about 1200° F.) can be referred to as a gas oil boiling range component while a hydrocarbon fraction boiling at a temperature ranging from about 220° C. to about 645° C. (about 420° F. to about 1200° F.) can be referred to as a full range gas oil/resid fraction or a long resid fraction.

Hydrocarbon fractions boiling at a temperature of below about 220° C. (about 420° F.) can be recovered as transportation fuels such as gasoline. Hydrocarbon fractions boiling at a temperature ranging from about 220° C. to about 355° C. (about 420° F. to about 675° F.) can be directed to transportation fuels such as distillate and diesel fuel product pools, or directed to another process for further upgrading to gasoline.

Hydrocarbon fractions boiling at a temperature of greater than about 535° C. (about 995° F.) can be regarded as residual fractions. Such residual fractions can include higher proportions of components that tend to form coke in the fluid catalytic cracking process. Residual fractions can contain higher concentrations of undesirable metals such as nickel and vanadium, which can catalyze the formation of coke. While upgrading residual components to higher value, lower boiling hydrocarbons can be profitable for the refiner, the deleterious effects of higher coke production, such as higher regenerator temperatures, lower catalyst to oil ratios, accelerated catalyst deactivation, lower conversions, and increased use of costly flushing or equilibrium catalyst for metals control can be weighed against these benefits.

Typical gas oil and long resid fractions can be derived from several refinery process sources including but not limited to a low, medium, or high sulfur crude unit atmospheric and/or vacuum distillation tower, a delayed or fluidized coking process, a catalytic hydrocracking process, and/or a distillate, gas oil, or resid hydrotreating process. Moreover, fluid catalytic cracking feedstocks can be derived as by-products from lubricating oil manufacturing facilities including, but not limited to a lubricating oil viscosity fractionation units, solvent extraction processes, solvent dewaxing processes, or hydrotreating processes. Moreover, fluid catalytic cracking feedstocks can be derived through recycle of various product streams produced at a fluid catalytic cracking process. Recycle streams such as decanted oil, heavy catalytic cycle oil, and light catalytic cycle oil can be recycled directly or may pass through other processes such as a hydrotreating process prior to use as a coke precursor in the fluid catalytic cracking process.

The dual riser process can be integrated with a steam pyrolysis unit. Integration of the catalytic and pyrolytic cracking units can allow for flexibility in processing a variety of feedstocks. The integration can allow thermal and catalytic cracking units to be used in a complementary fashion in a new or retrofitted petrochemical complex. The petrochemical complex can be designed to use the lowest value feedstreams available. Integration can allow for production of an overall product slate with increased value through routing of various by-products to the appropriate cracking technology.

Figure 2:
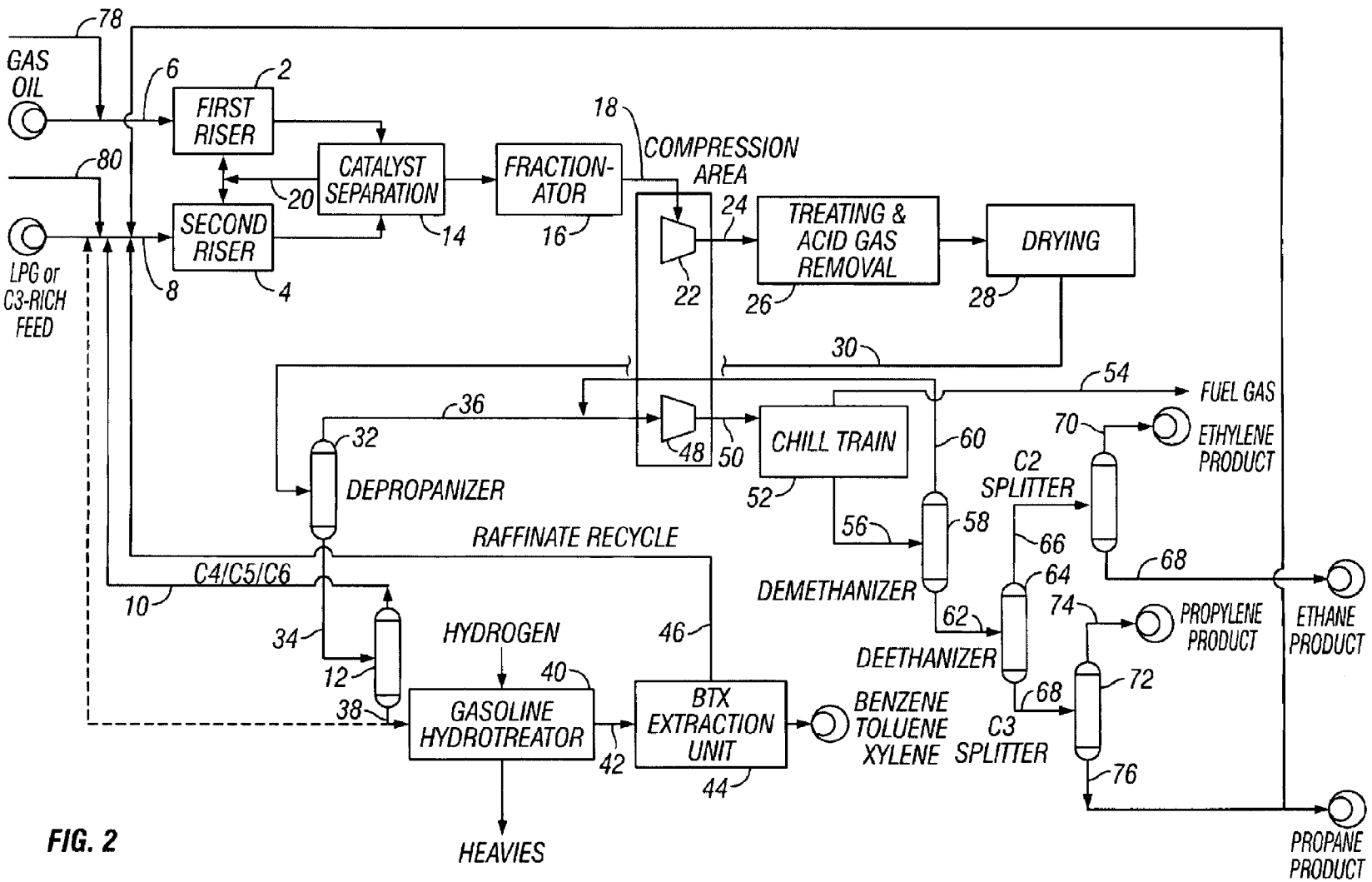
FIG. 2 is a block process flow diagram for an embodiment incorporating a dual-riser FCC reactor with one or more recycles from downstream processing.

FIG. 2 illustrates a general process flow for an embodiment described herein. The embodiment can be one incorporating a dual-riser catalytic cracker as described above (see FIG. 1), which can include a first riser 2 and a second riser 4 receiving respective gas oil and LPG or $C_3$-rich (LPG/$C_3$) feed streams 6, 8. The second riser 4 can be supplied with a feed stream comprising a recycle of effluent stream 10 from the gasoline splitter 12 as described below.

The effluents from the FCC first riser 2 and second riser 4, can pass through a catalyst separation device 14 before being fed to a fractionator 16 for separation of any heavy naphtha and heavier oils to yield olefin-rich stream 18. Catalyst separated in the catalyst separation device 14 can be stripped and regenerated before being returned in a catalyst recycle stream 20 to the first riser 2, second riser 4 or both. Stream 18 can be pressurized in compressor 22 to a pressure of from about 100 kPa to about 3500 kPa (about 10 psia to about 510 psia), depending on the separation scheme. The pressurized stream 24 can be subjected to treatment in a known treating and acid gas removal unit 26 to remove oxygenates, acid gases and any other impurities from the cracked gas stream, followed by drying in dryer 28. The dried stream 30 can be fed to depropanizer 32 where the stream can be fractionated into a heavier stream 34 containing $C_4$ and gasoline components and a lighter stream 36 containing $C_3$ and lighter components. The heavier stream 34 can be routed to a gasoline splitter 12 where the stream can be separated into a gasoline component stream 38 and the $C_4$, $C_5$ and/or $C_6$ effluent stream 10, which as previously mentioned can be recycled to the second riser 4.

The gasoline component stream 38 can be fed to a gasoline hydrotreater 40 for stabilization, or all or a portion can be recycled to the second riser 4.

The treated gasoline stream 42, containing $C_6$ and heavier hydrocarbons, can be fed to a BTX unit 44 for recovery of benzene, toluene, and/or xylene components. Any known BTX recovery unit is suitable. Exemplary BTX process units are described in U.S. Pat. No. 6,004,452. The raffinate recycle stream 46 can be fed to the second riser 4. Alternatively, stream 46 can be recycled to a pyrolytic cracker, or can be a product of the process.

The lighter stream 36 from the depropanizer can be compressed in compressor 48 to a pressure of from about 500 kPa to about 1500 kPa (about 70 psia to about 220 psia) to form pressurized stream 50 which can be routed to a cryogenic chill train 52. A light stream 54 can be removed from the chill train as a fuel gas, a product exported from the process, and/or for further processing such as hydrogen recovery or the like. The heavier stream 56 from the chill train can be fed to a series of separators for isolation of olefin streams. For example, the stream 56 can be fed to a demethanizer 58, which produces a light recycle stream 60 and a heavier product stream 62. The light recycle stream 60 can alternatively in whole or in part be a product of the process. The heavier product stream 62 can be routed to a deethanizer 64 where it can be separated into a light component stream 66 containing ethylene and a heavier stream 68 containing C3 and heavier components. Stream 66 can be separated into an ethylene product stream 70 and an ethane stream 72 that can be recycled to a steam pyrolysis unit, or can a product of the process. The heavier stream 68 from the deethanizer 64 can be routed to a $C_3$ splitter 72 where it can be split into a propylene product stream 74 and propane stream 76 that can be recycled to the second riser 4, or it can a product of the process. A suitable coke precursor can be fed to first riser 2 and/or second riser 4 via respective lines 78, 80.

EXAMPLES

The following examples are based on a combination of laboratory tests, pilot plant tests and preliminary engineering calculations. The examples demonstrate the novel operation of the FCC process of the present invention in improving overall yields for aromatics from LPG by using a gallium-promoted alumina catalyst.

Example 1 summarizes the results of an experimental run that was carried out in a bench-scale reactor. Substantially pure propane (in gaseous form) was used as the reactant and was fed from a pressurized cylinder through a fixed bed reactor with and without gallium promotion.

The reactor was about 2 meters (about 7 feet) tall, and was essentially a ½" schedule 40 stainless steel tube with an inside diameter of about 1.6 cm (about 0.62 inches). The whole reactor assembly was heated externally by electric coils wound around the reactor tube.

During the course of the reaction, temperatures, pressures and reactant/product gas flow rates were constantly monitored and logged. The temperature of the catalyst bed was precisely set and controlled at about 635° C. (about 1175° F.) by means of an internally positioned temperature controller. Multi-point temperature indicators were located at the inlet and the outlet of the reactor, and internal/skin thermocouples were placed in multiple locations along the reactor. The reactor was maintained at a pressure of about 170 kPa (about 10 psig) using a back pressure regulator.

Product gases exiting the reactor were cooled by heat exchange with chilled water from an automated chiller. The temperature of effluent gases at the exit of the heat exchanger was typically maintained around 18-21° C. (about 65-70° F.). This setup was designed to ensure that liquid products were condensed and separated in a product separator, while non-condensable hydrocarbon gases were flared after passing through a flow measurement device.

At half-hour intervals, product gases were collected in gas sampling bags and analyzed off-line using a gas chromatograph. The liquid product was collected in two stages; a first sample was withdrawn after about 3.5 hours of reactor operation, and a second sample was recovered at the end of the reaction, about 6.5 hours from the start of the reaction.

The liquid products were analyzed for BTX content and for other $C_5$-$C_{8+}$ hydrocarbons. The test conditions used for the run are listed in Table 1. The weight hourly space velocity (WHSV) is the ratio of the weight of the feed per hour to the weight of catalyst used.

TABLE 1

| Operating Conditions | | Base Case 1: Without Gallium | Example 1: Gallium-Promoted Catalyst |
|---|---|---|---|
| Feed | | Propane (99.5% ppm by volume) | Propane (99.5% ppm by volume) |
| Temperature | ° C. (° F.) | 635 (1175) | 635 (1175) |
| Pressure | kPa (psia) | 170 (10) | 170 (10) |
| Catalyst | | ZSM-5 with 40 weight percent crystal content | ZSM-5 with 40 weight percent crystal content containing 6.21 weight percent of Ga on catalyst |
| Catalyst Packing Height | cm (inches) | about 10 (about 4) | about 10 (about 4) |
| Catalyst Charge | g | about 20.0 | about 20.0 |
| Propane Feed Rate | 1 (scfh) | 24 (0.83) | 24 (0.83) |
| WHSV | $hr^{-1}$ | 2.2 | 2.2 |
| Contact Time | s | 2.7 | 2.7 |

While the surface areas of the Base Case 1 and Example catalyst samples were about the same, 158.32 $m^2/g$ and 164.5 $m^2/g$, respectively, the pore volume distribution varied notably. The pore volume distribution as a function of pore sizes is listed in Table 2.

TABLE 2

| | Pore Volume Distribution, % | |
|---|---|---|
| Pore Diameter, nm | Base Case 1: Without Gallium | Example 1: Gallium-Promoted Catalyst |
| <6 | 17 | 67 |
| 6-8 | 5 | 4 |
| 8-10 | 4 | 4 |
| 10-12 | 2 | 1 |
| 12-16 | 7 | 5 |
| 16-20 | 2 | 1 |
| 20-80 | 43 | 13 |
| >80 | 20 | 5 |

From Table 2, the addition of the Ga promoter resulted in an increase in the percentage of pores that are smaller than 6 nanometers, while lowering the percentage of larger pores. Smaller pore size can enhance aromatization reactions involving smaller alkanes such as propane because the smaller pores allow more selective diffusion of the reactant molecules.

Effluent gas sample results showed that significant volumes of hydrogen, ethylene, ethane and methane were produced. Further, the propane concentration in the exit stream ranged between 6.8-12.3 mole percent, indicating a high propane conversion of 88-93 mole percent. However, the propane conversion decreased as time progressed, essentially due to the coke build up on the catalyst.

A mass balance was performed using the average flow rates for the feed and effluent gases and for various time intervals. The results of the mass balance calculations are presented in Table 3. In Table 3, the amount of $C_6$+ for the 0-0.6 h interval was estimated, assuming no coke formation, from mass balance using the analyses of the gas bag samples because no liquid product was taken at that time.

TABLE 3

| | Mass Balance in Weight Percent Time Interval | | |
|---|---|---|---|
| Component | 0-0.6 h (assuming no coke) | 0-3.5 h | 0-6.5 h |
| Hydrogen | 2.5 | 2.0 | 1.7 |
| Ethylene | 10.4 | 13.4 | 16.0 |
| Ethane | 12.2 | 12.0 | 10.9 |
| Methane | 27.3 | 26.2 | 25.4 |
| Propane | 13.2 | 16.7 | 18.6 |
| Propylene | 5.3 | 8.6 | 11.3 |
| Isobutane | 0.1 | 0.1 | 0.1 |
| n-Butane | 0.3 | 0.2 | 0.2 |
| Butenes | 1.2 | 1.7 | 1.9 |
| $C_6$+ | 26.4 | 17.0 | 12.6 |
| Coke on Catalyst | 0.0 | n/a | 0.75 |
| Others | 1.1 | n/a | 0.55 |

From Table 3, the fraction of the $C_6$+ liquid product was higher during the initial period of the run, 0-0.6 h. This fraction steadily decreased as time progressed, suggesting a decline in catalytic activity.

The first liquid sample was obtained after 3.5 hours of reactor operation and was around 11.15 grams. A second sample was obtained after the reactor was shut down, after 6.5 hours of reactor operation, and weighed about 1 gram. Thus, the bulk of the gas-to-liquid conversion occurred during the first few hours of the reactor operation, which finding was confirmed by analysis of coke on the catalyst. At the end of the run, coke on catalyst was about 10.6 weight percent. Since, in the present fixed bed operation, no attempt was made to regenerate the catalyst, the catalyst effectiveness may have been compromised during much of the run length. Analysis of the liquid product is shown in Table 4.

TABLE 4

| Component | Weight % |
|---|---|
| Benzene | 19.7 |
| Toluene | 37.4 |
| Xylenes | 16.2 |
| Other Aromatics | about 20.0 |
| $C_2$-$C_{11}$ Olefins | 6.5 |
| Naphthenes | <0.1 |

From Table 4, more than 73 weight percent BTX was present in the sample. The total aromatics content was about 93 weight percent. The remaining constituents were light/heavy end olefins and minute quantities, <0.1 weight percent, of naphthenates.

The bench-scale results of Example 1 indicate that Ga-promoted ZSM-5 catalysts are suitable for enhancing BTX production from light alkane/LPG-type feeds.

Example 2 was conducted using a ZSM-5 catalyst and a 1-heptene feedstock to simulate an olefinic feedstock. The 1-heptene was not a pure heptene, but rather a composition of 85-88 weight percent $C_7$, with the remainder mostly $C_4$-$C_6$. Example 2 includes a base case in which no gallium has been added and a case wherein gallium has been added. To show the effect of gallium addition, the base case feed was cracked separately, but under similar conditions as in the example with gallium.

The Example 2 run was conducted in a laboratory. Operating conditions for the run are listed below in Table 5, and a summary of the resulting yields obtained is provided in Table 6.

TABLE 5

| Operating Conditions | Unit | Base Case 2: Without Ga | Example 2: Ga-Promoted Catalyst |
|---|---|---|---|
| Feed Rate | g/h | 1295 | 1307 |
| Cat/Oil Ratio | wt/wt | 15.5 | 15.3 |
| Catalyst Type | | Steamed Alumina | Steamed Alumina Containing 570 ppmw Gallium |
| Run Time | h | 6 | 4 |
| Operation Mode | | Adiabatic | Adiabatic |
| Average Riser Temperature | ° C. (° F.) | 639 (1183) | 639 (1182) |
| End of Riser Temperature | ° C. (° F.) | 634 (1173) | 634 (1174) |
| Catalyst Inlet Temperature | ° C. (° F.) | 716 (1321) | 717 (1323) |
| Mix Temperature | ° C. (° F.) | 647 (1196) | 634 (1173) |
| Disengager Temperature | ° C. (° F.) | 576 (1069) | 571 (1059) |
| Unit Pressure | kPa (psig) | 363 (38) | 363 (38) |
| Riser Hydrocarbon Partial Pressure (HCPP) | kPa (psia) | 193 (28.0) | 190 (27.5) |
| Post-riser HCPP | kPa (psia) | 156 (22.6) | 180 (26.1) |
| Riser Residence Time | s | 2.2 | 2.2 |

TABLE 6

| | Base Case 2: Without Ga | Example 2: Ga-Promoted Catalyst |
|---|---|---|
| Mass Balance | 99.03% | 98.97% |
| Raw Product Split (Normalized) | | |
| Coke | 0.40% | 0.51% |
| Gas | 68.93% | 65.59% |
| Liquid | 27.85% | 31.40% |
| Water | 2.82% | 2.50% |
| Normalized Yields (Weight Percent of Feed) | | |
| Hydrogen | 0.15 | 0.22 |
| CO | 0.35 | 0.40 |
| Carbon Dioxide | 0.06 | 0.16 |
| Methane | 2.68 | 2.86 |
| Ethane | 1.63 | 1.86 |
| Ethylene | 9.38 | 9.42 |
| Acetylene | 0.00 | 0.00 |
| Hydrogen Sulfide | 0.00 | 0.00 |
| Propane | 3.19 | 3.62 |
| Propylene | 26.10 | 22.28 |
| Cyclopentene | 0.00 | 0.00 |
| 1-(Methylamino)-2,3-Propandiol | 0.00 | 0.00 |
| n-butane | 0.99 | 0.99 |
| Iso-butane | 0.43 | 1.18 |
| Trans-2-butene | 4.31 | 3.20 |
| 1-butane | 3.66 | 2.75 |

TABLE 6-continued

| | Base Case 2: Without Ga | Example 2: Ga-Promoted Catalyst |
|---|---|---|
| Iso-butene | 7.38 | 5.81 |
| Cis-2-butene | 3.28 | 2.41 |
| 1,3-butadiene | 0.13 | 0.16 |
| Sum C4's | 20.17 | 16.51 |
| Sum C3's and C4's | 49.46 | 42.41 |
| C5 | | |
| Paraffin (P) | 0.07 | 0.07 |
| Iosparaffin (I) | 0.13 | 0.18 |
| Naphthene (N) | 0.07 | 0.25 |
| Olefin (O) | 4.62 | 9.78 |
| C6 | | |
| Aromatic (A) | 1.32 | 1.81 |
| Other | 8.73 | 4.25 |
| C7 | | |
| Aromatic (A) | 4.13 | 5.51 |
| Other | 6.13 | 7.17 |
| C8 | | |
| Aromatic (A) | 3.77 | 5.04 |
| Other | 1.31 | 1.56 |
| C9+, unknown | 2.79 | 4.04 |
| Coke | 0.40 | 0.51 |
| Water | 2.82 | 2.50 |
| BTX: | | |
| Benzene | 1.32 | 1.81 |
| Toluene | 4.13 | 5.51 |
| Xylene | 3.77 | 5.04 |
| Sum BTX | 9.22 | 12.36 |
| C5+ Gasoline | 33.06 | 39.65 |
| BTX in Gasoline (Weight Percent C5+) | 27.89 | 31.17 |
| E + P Yield (Weight percent) | 35.48 | 31.71 |

A comparison of the results in Table 6 shows that Example 2 with gallium-promoted catalyst yielded about the same amount of ethylene as did Base Case 2, but less propylene and more aromatics. Also, the propane yield was increased while total $C_3$-$C_4$ was reduced. However, an embodiment of the present invention can recycle the propane to the second riser under severe conditions, leading to further increased BTX and total gasoline yields.

The fluidized catalytic cracking processes described herein may be used in an arrangement for integrating cracking operations and petrochemical derivative processing operations.

All patents and publications referred to herein are hereby incorporated by reference in their entireties to the extent they are not inconsistent with the present invention and to the extent permitted under the patent practice rules of the US and other jurisdictions.

Although the various embodiments and their advantages have been described in detail, it should be understood that various changes, substitutions, and alterations could be made without departing from the spirit and scope of the invention as defined by the following claims.

What is claimed is:

1. A fluid catalytic cracking (FCC) process for converting a $C_3/C_4$-rich feed to olefins and aromatics, comprising:

cracking a first hydrocarbon feed comprising heavy hydrocarbons having greater than 12 carbon atoms in a first riser under first-riser FCC conditions to form a first effluent enriched in cracked hydrocarbons, wherein the first-riser FCC conditions include a residence time from 0.1 to 10 seconds;

cracking a second hydrocarbon feed comprising light hydrocarbons having 12 or less carbon atoms, in a second riser under second-riser FCC conditions to form a second effluent enriched in light olefins and aromatics, wherein the second-riser FCC conditions have a higher severity than the first-riser FCC conditions and include a residence time from 0.1 to 10 seconds and a temperature from 510° C. to 710° C. (950° F. to 1300° F.), wherein the first riser and the second riser contain gallium-promoted alumina catalyst;

recovering the catalyst from the first riser and the second riser;

separating hydrocarbons including light olefins and aromatics from the first and second FCC effluents, wherein the second hydrocarbon feed further comprises a recycle stream comprising propane recovered from the separated hydrocarbons;

regenerating the recovered catalyst by combustion of coke in a common regenerator to obtain hot, regenerated catalyst; and recirculating the hot regenerated catalyst to the first and second risers.

2. The FCC process of claim 1, wherein the first hydrocarbon feed comprises gas oil.

3. The FCC process of claim 1 wherein the second hydrocarbon feed comprises liquefied petroleum gas (LPG).

4. The FCC process of claim 1 wherein the second-riser FCC conditions comprise, relative to the first-riser FCC conditions, a higher temperature, higher catalyst-to-oil ratio, lower hydrocarbon partial pressure, lower steam-to-oil ratio, longer residence time, or any combination thereof.

5. The FCC process of claim 1 wherein the recycle stream comprises paraffinic and cycloparaffinic hydrocarbons having from 3 to 12 carbon atoms.

6. The FCC process of claim 1, further comprising:

conditioning gas separated from the first and second effluents to remove oxygenates, acid gases, water or a combination thereof to form a conditioned stream; and separating the conditioned stream into at least a tail gas stream, an ethylene product stream, a propylene product stream, a light stream comprising ethane, propane, or a combination thereof, an intermediate stream comprising olefin selected from $C_4$ to $C_6$ olefins and mixtures thereof, and a heavy stream comprising $C_6$ and higher hydrocarbons.

7. The FCC process of claim 6, wherein the first and second effluents are mixed and conditioned together in a common conditioning unit.

8. The FCC process of claim 6, further comprising:

hydrotreating at least a portion of the heavy stream to obtain a hydrotreated stream;

extracting a product stream comprising benzene, toluene, xylenes or a mixture thereof from the hydrotreated stream to obtain a raffinate stream lean in aromatics; and recycling the raffinate stream to the second riser.

9. A fluid catalytic cracking (FCC) process for converting a $C_3/C_4$-rich feed to olefins and aromatics, comprising:

cracking a first hydrocarbon feed in a first riser under first-riser FCC conditions to form a first effluent enriched in cracked hydrocarbons, wherein the first hydrocarbon feed comprises heavy hydrocarbons having greater than 12 carbon atoms, and wherein the first-riser FCC conditions include a residence time from 0.1 to 10 seconds;

cracking a second hydrocarbon feed comprising light hydrocarbons having 12 or less carbon atoms, in a second riser under second-riser FCC conditions to form a second effluent enriched in light olefins and aromatics, wherein the second-riser FCC conditions have a higher severity than the first-riser FCC conditions and include a residence time from 0.1 to 10 seconds and a temperature from 510° C. to 710° C. (950° F. to 1300° F.), wherein the first riser and the second riser contain gallium-promoted alumina catalyst;

recovering the catalyst from the first riser and the second riser;

separating hydrocarbons from the first and second FCC effluents to provide: a light stream comprising ethane, propane, or a combination thereof; an intermediate stream comprising one or more olefins selected from $C_4$ to $C_6$ olefins and mixtures thereof; and a heavy stream comprising $C_6$ and higher hydrocarbons;

regenerating the recovered catalyst by combustion of coke in a common regenerator to obtain hot, regenerated catalyst;

recirculating the hot regenerated catalyst to the first and second risers; and recycling the light stream, intermediate stream, and heavy stream to the second riser.

10. The FCC process of claim 9, wherein the first hydrocarbon feed comprises gas oil and the second hydrocarbon feed comprises liquefied petroleum gas (LPG).

11. The FCC process of claim 9, wherein the first hydrocarbon feed comprises gas oil and the second hydrocarbon feed comprises liquefied petroleum gas (LPG).

12. The FCC process of claim 9, further comprising:

hydrotreating at least a portion of the heavy stream to obtain a hydrotreated stream;

extracting a product stream comprising benzene, toluene, xylenes or a mixture thereof from the hydrotreated stream to obtain a raffinate stream lean in aromatics; and recycling the raffinate stream to the second riser.

13. The FCC process of claim 9, further comprising:

conditioning gas separated from the first and second effluents to remove oxygenates, acid gases, water or a combination thereof to form a conditioned stream; and separating the conditioned stream into at least a tail gas stream, an ethylene product stream, a propylene product stream, a light stream comprising ethane, propane, or a combination thereof, an intermediate stream comprising olefin selected from $C_4$ to $C_6$ olefins and mixtures thereof, and a heavy stream comprising $C_6$ and higher hydrocarbons.

14. A fluid catalytic cracking (FCC) process for converting a $C_3/C_4$-rich feed to olefins and aromatics, comprising:

cracking a first hydrocarbon feed comprising a heavy hydrocarbon having greater than 12 carbon atoms in a first riser under first-riser FCC conditions to form a first effluent enriched in cracked hydrocarbons, wherein the first-riser FCC conditions include a residence time from 0.1 to 10 seconds;

cracking a second hydrocarbon feed having 12 or less carbon atoms in a second riser under second-riser FCC conditions to form a second effluent enriched in light olefins and aromatics, wherein the second-riser FCC conditions have a higher severity than the first-riser FCC conditions and include a residence time from 0.1 to 10 seconds and a temperature from 510° C. to 710° C. (950° F. to 1300° F.), wherein the first riser and the second riser contain gallium-promoted alumina catalyst;

recovering the catalyst from the first and second risers;

separating hydrocarbons from the first and second FCC effluents to provide: a light stream comprising ethane, propane, or a combination thereof; an intermediate stream comprising one or more olefins selected from $C_4$ to $C_6$ olefins and mixtures thereof; and a heavy stream comprising $C_6$ and higher hydrocarbons;

regenerating the recovered catalyst by combustion of coke in a common regenerator to obtain hot, regenerated catalyst;

spraying a solution of gallium onto the hot regenerated catalyst;

recirculating the hot regenerated catalyst to the first and second risers; and recycling the light stream, the intermediate stream, and the heavy stream to the second riser.

15. The FCC process of claim 14, wherein the first hydrocarbon feed comprises gas oil and the second hydrocarbon feed comprises liquefied petroleum gas (LPG).

16. The FCC process of claim 14, wherein the first hydrocarbon feed comprises gas oil and the second hydrocarbon feed comprises liquefied petroleum gas (LPG).

17. The FCC process of claim 14, wherein the second hydrocarbon feed further comprises a recycle stream recovered from the separated hydrocarbons, wherein the recycle stream comprises propane.

18. The FCC process of claim 14, further comprising:

hydrotreating at least a portion of the heavy stream to obtain a hydrotreated stream;

extracting a product stream comprising benzene, toluene, xylenes or a mixture thereof from the hydrotreated stream to obtain a raffinate stream lean in aromatics; and recycling the raffinate stream to the second riser.

* * * * *